US009979115B2

(12) United States Patent
Bez et al.

(10) Patent No.: US 9,979,115 B2
(45) Date of Patent: May 22, 2018

(54) ASSEMBLY FOR MARKING AT LEAST ONE CONNECTION OF A COMPUTER SYSTEM, CONNECTION MODULE AND LABELLING ELEMENT

(71) Applicant: FUJITSU LIMITED, Kawasaki-shi, Kanagawa (JP)

(72) Inventors: Mario-Antonio Bez, München (DE); Ralf-Peter Fietz, München (DE); Bernhard Gut, München (DE); Friedrich Köhler, München (DE); Toni Koberling, München (DE); Georg Venus, München (DE)

(73) Assignee: FUJITSU LIMITED, Kawasaki (JP)

( * ) Notice: Subject to any disclaimer, the term of this patent is extended or adjusted under 35 U.S.C. 154(b) by 0 days. days.

(21) Appl. No.: 15/319,615

(22) PCT Filed: Sep. 2, 2015

(86) PCT No.: PCT/EP2015/070081

§ 371 (c)(1),
(2) Date: Dec. 16, 2016

(87) PCT Pub. No.: WO2016/041777

PCT Pub. Date: Mar. 24, 2016

(65) Prior Publication Data

US 2017/0149163 A1 May 25, 2017

(30) Foreign Application Priority Data

Sep. 19, 2014 (DE) ..... 10 2014 113 578

(51) Int. Cl.
*H01R 3/00* (2006.01)
*H01R 13/46* (2006.01)
(Continued)

(52) U.S. Cl.
CPC ..... *H01R 13/465* (2013.01); *H01R 24/64* (2013.01); *H01R 2107/00* (2013.01)

(58) Field of Classification Search
CPC ... H01R 2107/00; H01R 24/64; H01R 13/465
(Continued)

(56) References Cited

U.S. PATENT DOCUMENTS 7,134,200 B2 * 11/2006 Boldy ..... H01R 13/465 116/200
7,429,191 B2 * 9/2008 Diaz ..... H01R 13/465 439/540.1

(Continued)

FOREIGN PATENT DOCUMENTS

DE 102004033940 2/2006
DE 102007015234 9/2008

*Primary Examiner* — Abdullah Riyami
*Assistant Examiner* — Nelson R Burgos-Guntin
(74) *Attorney, Agent, or Firm* — Fujitsu Patent Center

(57) ABSTRACT

The invention relates to an assembly for marking at least one connection of a computer system. The assembly comprises a housing with an outer wall, in which a recess is formed. Furthermore, at least one connection is provided, which is accessible from outside the housing via the recess of the housing. The assembly is characterized in that a labelling element can be secured within the housing such that at least one section of the labelling element which can be provided with a marking and which is assigned to the at least one connection projects outwards from the housing through the recess. Furthermore, the invention relates to a connection module and to a labelling element.

15 Claims, 2 Drawing Sheets

Figure 1:
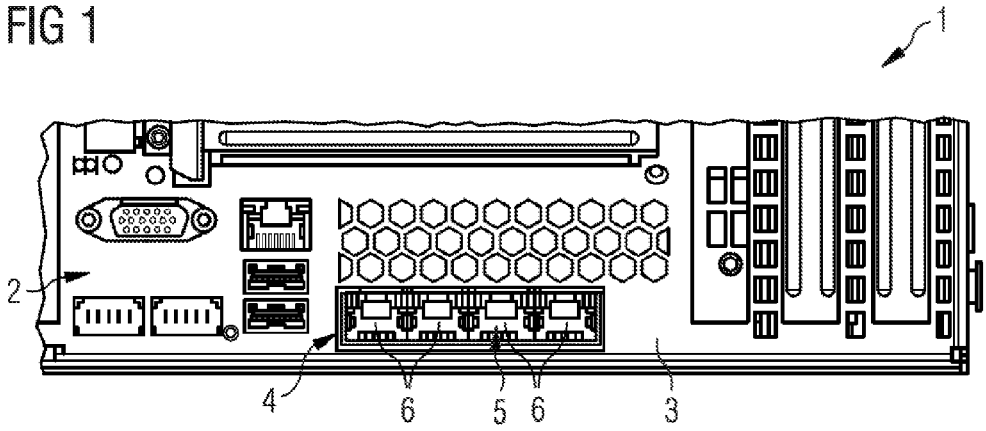

(51) Int. Cl.
*H01R 24/64* (2011.01)
*H01R 107/00* (2006.01)

(58) Field of Classification Search
USPC ..... 439/491, 76.1, 488, 138, 483
See application file for complete search history.

(56) References Cited

U.S. PATENT DOCUMENTS

| | | | | |
|---|---|---|---|---|
| 7,526,582 | B2 * | 4/2009 | Best | H01R 9/2475 439/488 |
| 7,740,282 | B2 * | 6/2010 | McNutt | H04Q 1/136 283/109 |
| 7,850,371 | B2 * | 12/2010 | Riley | G02B 6/3849 385/75 |
| 8,376,760 | B1 * | 2/2013 | Kostrzewski | H01R 13/4538 235/493 |
| 9,019,968 | B2 * | 4/2015 | Shar | H04Q 1/136 370/400 |
| 2002/0058439 | A1 * | 5/2002 | Ewell | H01R 13/465 439/491 |
| 2003/0177676 | A1 * | 9/2003 | Caveney | G09F 3/20 40/299.01 |
| 2004/0154197 | A1 | 8/2004 | Hishinuma et al. | |
| 2007/0274515 | A1 | 11/2007 | McNutt et al. | |
| 2013/0064249 | A1 | 3/2013 | Shar et al. | |
| 2017/0149163 | A1 * | 5/2017 | Bez | H01R 13/465 |

* cited by examiner

ASSEMBLY FOR MARKING AT LEAST ONE CONNECTION OF A COMPUTER SYSTEM, CONNECTION MODULE AND LABELLING ELEMENT

Assembly for marking at least one connection of a computer system, connection module and labelling element The invention relates to an assembly for marking at least one connection of a computer system which comprises a housing. Furthermore, the invention relates to a connection module as well as to a labelling element.

Computer systems usually have a plurality of connections, which are arranged on a back wall or a front wall of a computer housing, for example. The connections are LAN, USB, audio and/or monitor connections, for example. The connections are often labelled by the manufacturer in order to indicate the function of the connections to a user of the computer system.

One object underlying the invention is to describe an assembly which allows an easy, space-saving and clearly visible marking of connections of a computer system.

According to a first aspect of the invention, an assembly for marking at least one connection of a computer system is described. The assembly comprises a housing of the computer system with an outer wall, in which a recess is formed. Furthermore, at least one connection is provided, which is accessible from outside the housing via the recess of the housing. The assembly is characterized in that a labelling element is secured in the housing in such a way that at least one section of the labelling element, which can be provided with a marking and which is assigned to the at least one connection, protrudes outward from the housing through the recess.

A modular marking of a predetermined connection of the computer system is enabled by the labelling element regardless of the outer wall of the housing per se. The marking includes any alphanumeric character, symbol and/or graphics for the labelling of the connection. The modularity of the labelling element allows changing the marking of the connection when re-arranging the connection by exchanging the labelling element. Just as well, when the connection is physically replaced or exchanged by another connection, the labelling element can be adapted or exchanged accordingly. Furthermore, an elaborate labelling of the outer wall of the housing can be omitted, for example engraving or lasing of markings in the outer wall or sticking them on the outer wall. Therefore, space is not needed on or within the housing and/or on the connection per se for the marking of the connection as a result. This is particularly advantageous when compact computer systems are concerned, in which connections are arranged close to one another. Furthermore, it is possible to assign, in particularly physically, one section of the labelling element directly to one or multiple connections. For example, a corresponding section of the labelling element may protrude outward above or below the connection.

Preferably, the labelling element is formed as a flexible foil, in particular a plastic foil. This allows bending the outward-protruding connection of the labelling element away for a contacting of the connection. This ensures that the connection can always be accessed without obstacles, in particular when multiple connections are located close next to one another.

According to another embodiment, the labelling element snaps with the housing for being secured. As a result, the labelling element can be secured and removed again from the housing in a simple manner. Furthermore, additional components for securing are not required.

According to another embodiment, the assembly comprises a connection module, which comprises the at least one connection and which is secured within the housing. The labelling element can be secured to the connection module. The connection module is formed as an assembly unit. Besides the connection, the connection module comprises a circuit board, for example, and can be coupled to the main board in the housing in terms of signaling and in a mechanical fashion. Typically, the connection module comprises a group of multiple connections of the same type, RJ-45 or USB connections, for example. The assembly unit enables easy installation and de-installation of one or multiple connections.

Preferably, the connection module comprises a mounting gap, into which the labelling element can be inserted for being latched or secured. As a result, the labelling element can be secured on the connection module in a particularly space-saving manner.

According to another embodiment, the connection module comprises a metal plug cover having an opening aligned with the outer wall, in which the at least one connection in encased. The mounting gap is formed between a side of the plug cover bounding the opening and the connection. This allows inserting the labelling element between the plug connector and the plug cover. As a result, means that allow securing the labelling element to the housing do not have to be provided in the housing. Thus, the labelling element and the connection module represent a modular, variable construction unit.

According to another embodiment, the labelling element comprises one or multiple latching elements for latching with the connection module, which are formed from the labelling element, in particular punched and/or embossed. For example, a latching element snaps in front of or behind the side bounding the opening in a plug-in or insertion direction of the labelling element.

According to another embodiment, a section of the labelling element protruding outward through the recess is assigned to two connections. A region of the mounting gap between the two sections remains free from the labelling element so that an electrically conductive connection between one or multiple connections and the plug cover can be established for EMC shielding in this region. This ensures a sufficient EMC shielding.

According to a second aspect of the invention, a connection module for an assembly with the housing according to the first aspect is disclosed. The connection module comprises a labelling element as well as a connection assigned to the labelling element, wherein the connection module can be secured within the housing.

According to a third aspect of the invention, a labelling element for a connection module according to the second aspect of the invention is described.

The second and third aspects of the invention essentially allow for the above-mentioned functions and advantages.

Further embodiments and advantages are described with reference to the following, detailed description of an exemplary embodiment using the attached figures.

Figure 2:
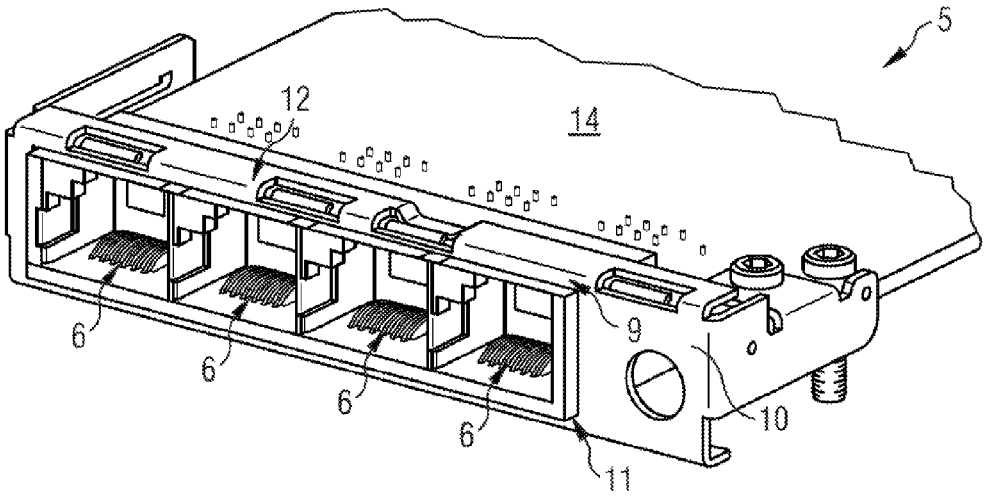
Figure 3:
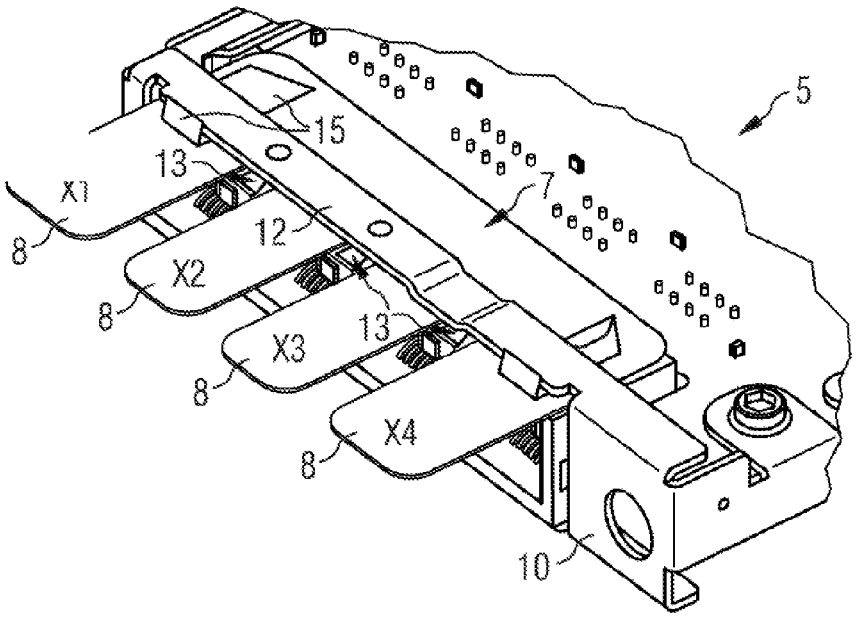
Figure 4:
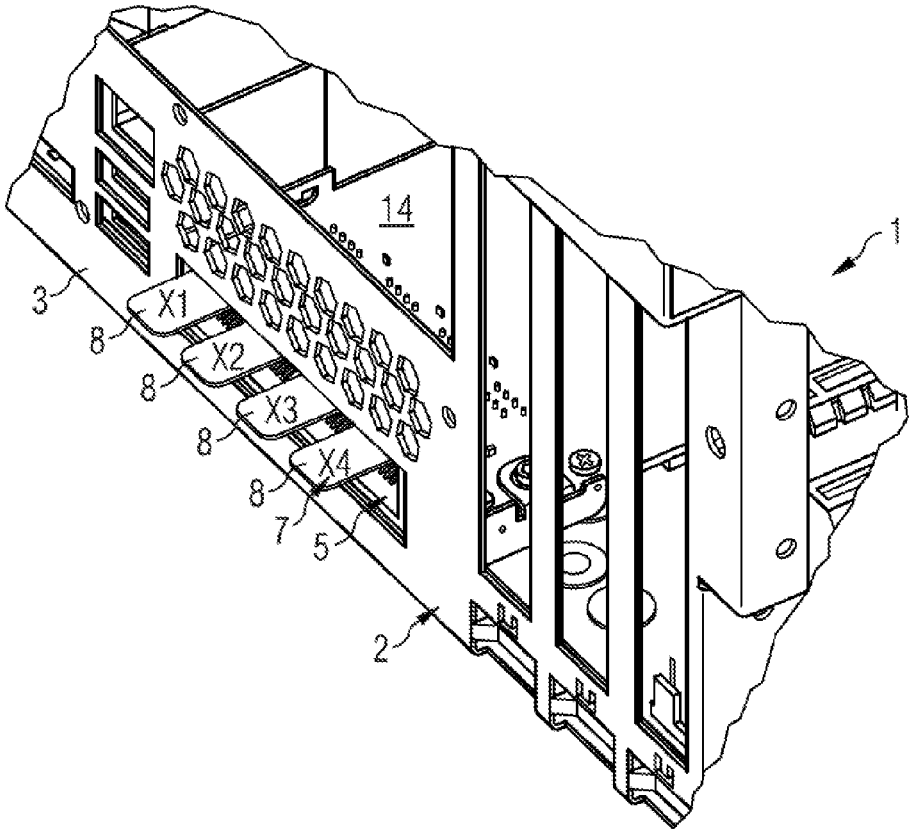

The figures show in:

FIG. 1 a view from the back of a computer system with a connection module,

FIG. 2 a perspective view of the connection module,

FIG. 3 a perspective view of the connection module with a labelling element, and FIG. 4 a perspective view from the back of the computer system with the connection module and the labelling element.

FIG. 1 shows a view from the back of a computer system 1. The computer system 1 is a so-called mini PC. As an alternative, the computer is a desktop or tower computer. The computer system 1 comprises a housing 2. A recess 4 is formed in an outer wall 3 of the housing 2, via which a connection module 5 having four connections 6 is accessible. In the exemplary embodiment, the outer wall 3 is a rear wall of the housing 2. The connection module 5 is shown in greater detail in the perspective view of FIG. 2.

The connections 6 are plug connector sockets of the RJ-45 network connector type. As an alternative, the connections are one or multiple other types of connections. Instead of the RJ-45 connections, USB connections or further connections may be provided as well. The connections 6 are encased in a metal plug cover 10. To that end, the plug cover 10 comprises an opening 11, which is aligned with the recess 4 of the housing 2. The connections 6 are coupled to a circuit board 14 of the connection module 5 in terms of signaling as well as in a mechanical fashion. The connection module 5 is mechanically secured within the housing 2. For EMC reasons, the plug cover 10 is in contact with the outer wall 3 in an electrically conductive manner. A mounting gap 9 of 0.4 mm is formed between the connections 6 and a side 12 on the side 12 bounding the opening 11. Of course, the gap may be formed larger or smaller as well.

As shown in FIG. 3, a labelling element 7, which is formed as a flexible plastic foil, is inserted in the mounting gap 9 and latched with the connection module 5. The labelling element 7 comprises four sections 8, which protrude outward from the connection module 5. Here, one section 8 is physically directly assigned to each connection 6. The sections 8 are provided with a marking X1 to X4. The sections 8 can also be referred to as protruding lugs of the labelling element 7.

Recesses 13 are formed in the labelling element 7 between the sections 8 in the region of the mounting gap 9. In these regions of the mounting gap 9, the connections 6 are electrically conductively contacted to the plug cover 10 for a sufficient EMC shielding, for example by means of small springs. These springs are bent away when inserting the labelling element 7.

For latching with the connection module 5, the labelling element 7 comprises multiple latching and/or stop elements 15 punched out of the labelling elements 7. These are formed as small lugs and latch in front of or behind the side 12 bounding the gap. Thus, the labelling element 7 is reliably secured in the mounting gap between the plug cover 10 and the connections 6.

FIG. 4 shows a perspective view of the computer system with the connection module 5 and the inserted labelling element 7. Here, it can be discerned that the sections 8 protrude outward out of the recess 4.

The assembly described enables a modular and flexible marking of the connections 6. The labelling element 7 may be exchanged modularly when exchanging the connection module 5 by a module with merely three or less connections, for example. The housing 2 does not have to be labelled per se. The labelling element 7 may readily be exchanged, if required. To that end, it merely has to be pulled out of the mounting gap 9, thus releasing the latch. Furthermore, the connections 6 can be labelled in a particularly space-saving manner.

LIST OF REFERENCE NUMERALS

1 computer system
2 housing
3 outer wall
4 recess
5 connection module
6 connection
7 labelling element
8 section
9 mounting gap
10 plug cover
11 opening
12 side
13 recess
14 circuit board
15 latching element
X1 to X4 markings

The invention claimed is:

1. An assembly for marking at least one connection of a computer system, comprising a housing with an outer wall, in which a recess is formed;

at least one connection, which is accessible from outside the housing via the recess of the housing; and a labelling element being secured within the housing in such a way that at least one section of the labelling element, which can be provided with a marking, and which is assigned to the at least one connection, protrudes outwards from the housing through the recess, wherein the labelling element is designed as a flexible foil.

2. The assembly according to claim 1, wherein the labelling element is designed as a plastic foil.

3. The assembly according to claim 1, wherein the labelling element latches for being secured.

4. The assembly according to claim 1, further comprising a connection module, which comprises the at least one connection and is secured within the housing, wherein the labelling element can be secured on the connection module.

5. The assembly according to claim 4, wherein the connection module comprises a mounting gap, into which the labelling element can be inserted for being secured.

6. The assembly according to claim 5, wherein the connection module comprises a metal plug cover having an opening aligned with the recess, in which the at least one connection is encased, wherein the mounting gap is formed between a side of the plug cover bounding the opening and the at least one connection.

7. The assembly according to claim 4, wherein the labelling element comprises one or multiple latching elements for latching with the connection module, which are formed from the labelling element, in particular punched and/or embossed.

8. The assembly according to claim 6, wherein at least two connections are assigned a section of the labelling element protruding outward through the recess and wherein a region of the mounting gap between the two sections remains free from the labelling element so that in this region an electrically conductive connection between one or multiple connections and the plug cover can be established for an EMC shield.

9. A connection module for an assembly having a housing according to claim 1, comprising a labelling element as well as at least one connection assigned to the labelling element, wherein the connection module can be secured within the housing.

10. A labelling element for a connection module according to claim 9, wherein the labelling element can be secured on the connection module.

11. The assembly according to claim 1, wherein the labelling element enables a modular marking of the at least one connection of the computer system regardless of the outer wall of the housing.

12. The assembly according to claim 1, wherein the labelling element is formed to allow changing the marking of the at least connection when re-arranging the connection by exchanging the labelling element.

13. An assembly for marking at least one connection of a computer system, comprising a housing with an outer wall, in which a recess is formed;

at least one connection, which is accessible from outside the housing via the recess of the housing; and a labelling element is a plastic, flexible foil and is secured within the housing in such a way that at least one section of the labelling element, which can be provided with a marking, and which is assigned to the at least one connection, protrudes outwards from the housing through the recess.

14. The assembly according to claim 1, wherein the labelling element is configured to receive a labelling mark.

15. The assembly according to claim 11, wherein the labelling mark is manually applied.

* * * * *